United States Patent [19]

Shibuya

[11] Patent Number: 4,544,332

[45] Date of Patent: Oct. 1, 1985

[54] DOUBLE ACTING TYPE COMPRESSOR

[75] Inventor: Tsunenori Shibuya, Konan, Japan

[73] Assignee: Diesel Kiki Co., Ltd., Tokyo, Japan

[21] Appl. No.: 520,137

[22] Filed: Aug. 4, 1983

[30] Foreign Application Priority Data

Aug. 12, 1982 [JP] Japan ..... 57-122593[U]

[51] Int. Cl.[4] ..... F04B 39/00; F04B 1/16; F04B 1/18

[52] U.S. Cl. ..... 417/269; 417/313

[58] Field of Search ..... 417/269, 313

[56] References Cited

U.S. PATENT DOCUMENTS

| | | | |
|---|---|---|---|
| 3,785,751 | 1/1974 | Nomoto | 417/269 |
| 4,221,544 | 9/1980 | Ohta | 417/269 |
| 4,299,543 | 11/1981 | Shibuya | 417/269 |
| 4,347,046 | 8/1982 | Brucken | 417/269 |
| 4,401,414 | 8/1983 | Ishizuka | 417/269 |
| 4,416,190 | 11/1983 | Ishizuka | 417/269 |

*Primary Examiner*—William L. Freeh

*Attorney, Agent, or Firm*—Frishauf, Holtz, Goodman & Woodward

[57] ABSTRACT

A double acting type compressor has a main body which is formed by a cylinder block and a pair of cylinder heads secured to opposite ends of the cylinder block. The main body is formed therein with a pair of discharge chambers arranged at opposite ends thereof, a discharge passageway communicating the discharge chambers with each other, and a discharge port communicating substantially directly with the discharge passageway. A pulsation attenuating means formed of a multiplicity of small through holes is provided between each of the discharge chambers and the discharge passageway. Compression medium in each of the discharge chambers flows into the discharge passageway through the small through holes of the pulsation attenuating means, while simultaneously having its pulsations attenuated, and then is supplied into an associated external circuit through the discharge port.

5 Claims, 5 Drawing Figures

DOUBLE ACTING TYPE COMPRESSOR

BACKGROUND OF THE INVENTION

This invention relates to double acting type compressors, and more particularly to a swash-plate type compressor which is adapted to attenuate pulsations of the compression medium being discharged from the compressor, thereby being low in noise.

Double acting type compressors are generally used as refrigerant compressors in air conditioning systems for vehicles, and typically they comprise a main body formed by a cylinder block and a pair of cylinder heads secured to opposite ends of the cylinder block. The main body has its opposite ends formed with a pair of suction chambers and a pair of discharge chambers, the chambers of each pair communicating with each other via a suction passageway or a discharge passageway formed in the main body. The main body is also formed therein with a suction port opening in one of the suction chambers as well as a discharge port opening in one of the discharge chambers, the ports being connected to an external circuit associated with the compressor.

The cylinder block has at least one cylinder bore formed therein, in which is slidably received a double headed piston which cooperates with the cylinder bore to define pump working chambers therebetween.

As the piston reciprocatingly moves within the cylinder bore, compression medium is sucked into each of the pump working chambers through the suction port and a corresponding one of the suction chambers, compressed therein and discharged into a corresponding one of the discharge chambers, followed by being supplied to the discharge port via the discharge passageway or directly, and then discharged into the external circuit.

In such type compressor, compression medium is discharged into the discharge chambers alternately from the two pump working chambers, that is, in a discontinuous manner. Therefore, the compression medium being discharged is pulsative. However, the compression medium is discharged into the external circuit without having its pulsations attenuated. Such pulsations of the discharge compression medium cause a considerable level of noise during operation of the compressor.

If a muffler is arranged in the compressor or a snubber chamber is formed in the compressor in order to reduce noise caused by the pulsations of the discharge compression medium, the whole size of the compressor will inevitably be large, providing many inconveniences.

SUMMARY OF THE INVENTION

It is the object of the invention to provide a double acting type compressor which is adapted to attenuate or suppress the pulsations of the discharge compression medium, thereby being low in noise.

According to the invention, there is provided a double acting type compressor which comprises a main body formed by a cylinder block and a pair of cylinder heads secured to opposite ends of the cylinder block. The main body of the compressor has formed therein a pair of discharge chambers arranged at opposite ends thereof, a discharge passageway communicating the discharge chambers with each other, and a discharge port communicating substantially directly with the discharge passageway. A pair of pulsation attenuating means are interposed between the discharge chambers and the discharge passageway. The pulsation attenuating means each comprises a multiplicity of small through holes communicating the corresponding discharge chamber with the discharge passageway. The small through holes of each of the pulsation attenuating means have a substantially reduced total cross-sectional area relative to the crosssectional area of the above corresponding one of the discharge chambers so as to impart substantially increased flow resistance to the compression medium passing the small through holes, while the discharge passageway has a cross-sectional area a substantially large cross-sectional area relative to the total crosssectional area of the small through holes of each of the pulsation attenuating means. Thus, the compression medium has its pulsations substantially attenuated as it travels from the two discharge chambers through the small through holes into the discharge passageway.

The above and other objects, features and advantages of the invention will be more apparent from the ensuing detailed description taken in conjunction with the accompanying drawings.

DETAILED DESCRIPTION

Figure 1:
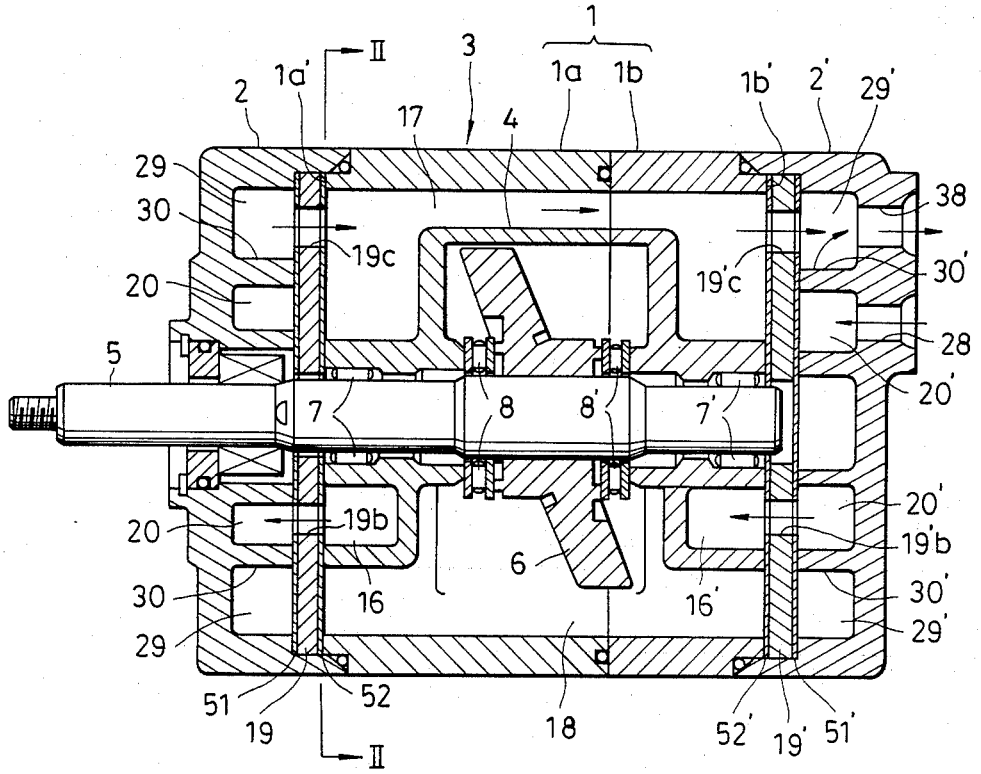
FIG. 1 PRIOR ART
FIG. 1 is a longitudinal sectional view illustrating a typical example of conventional swash-plate type compressor of the double acting type.
Figure 2:
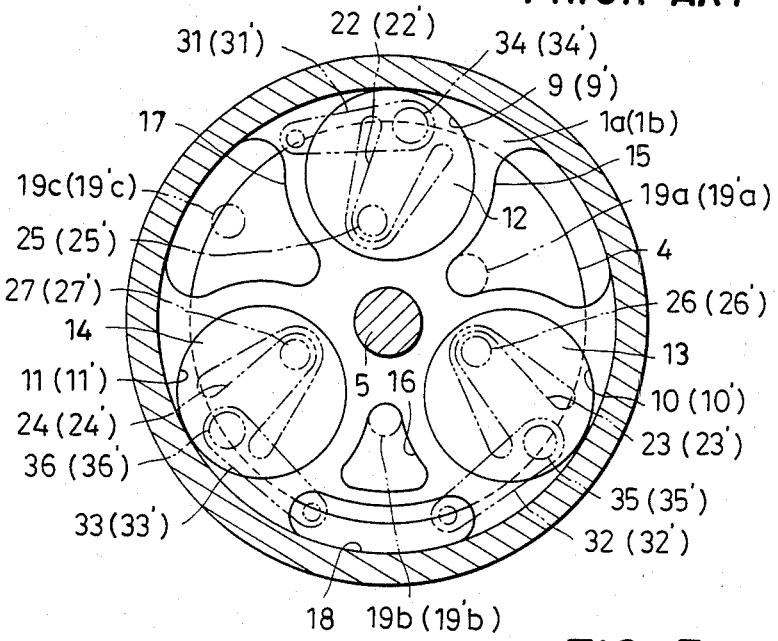
FIG. 2 PRIOR ART
FIG. 2 is a cross-sectional view taken along line II—II in FIG. 1.

Referring first to FIGS. 1 and 2, there is illustrated a conventional swash-plate type compressor of the double acting type. Reference numeral 1 designates a cylinder block which is formed by two cylindrical members 1*a* and 1*b* combined together in axial alignment. This cylinder block 1 cooperates with a pair of front and rear cylinder heads 2 and 2' secured to opposite ends of the cylinder block 1 to form a main body 3 of the compressor. Defined within the main body 3 at a central location is a swash plate chamber 4 within which is mounted a swash plate 6 rigidly fitted aslant on a drive shaft 5 which is rotatably supported by a pair of radial bearings 7 and 7' and a pair of thrust bearings 8 and 8' mounted in the cylinder block 1. Formed in the cylindrical members l*a*, l*b* of the cylinder block 1 are three pairs of front and rear cylinder bores 9, 9'; 10, 10'; 11, 11', the cylinder bores of each pair being combined together in axial alignment. The three pairs of cylinder bores are circumferentially arranged at substantially equal intervals. Three double headed pistons 12, 13 and 14 are slidably fitted within respective ones of the paired cylinder bores 9, 9'; 10, 10'; 11, 11', for defining at their opposite end faces pump working chambers, not shown, in cooperation with the cylinder bores. Each of the pistons 12, 13, 14 has its central inner portion formed with a recess, not shown, in which the swash plate 6 is fitted at its outer fringe in slidable engagement with the piston via balls and shoes, not shown. Formed between adjacent ones of the cylinder bores 12 and 13, and 12 and 14 are a suction passageway 15 and a discharge passageway 17, each of which has a substantially sectorial cross section at its central portion and an arcuate cross section at its opposite end portions and axially extends through the cylinder block 1. Defined between the adjacent cylinder bores 13, 14 are front and rear suction spaces 16 and 16' in the form of blind holes having a substantially sectorial cross section, which inwardly extend from the respective opposite end faces of the cylinder block 1 and parallel with the suction passageway 15 to serve to reduce the flow resistance which suction medium undergoes as it is sucked into the compressor. An oil sump 18 is formed in the cylinder block 1 at its bottom at a location radially outward of the suction spaces 16, 16'.

A pair of front and rear valve plates 19 and 19' are interposed between the opposite end faces 1*a'*, 1*b'* of the cylinder block 1 and the front and rear cylinder heads 2, 2' with gaskets 51 and 51' interposed between the valves plates and the cylinder heads 2, 2'. Front and rear suction chambers 20 and 20', each in the form of an annulus, are formed in the inner end faces of the respective cylinder heads 2, 2' and communicate with the suction passageway 15 via suction through holes 19*a* and 19*a'* formed through the respective valve plates 19, 19', as well as with the respective suction spaces 16, 16' via further through holes 19*b* and 19*b'* formed through the respective valve plates 19, 19'. The front and rear suction chambers 20, 20' communicate with the cylinder bores 9, 9'; 10, 10'; 11, 11' via inlet openings 25, 25'; 26, 26'; 27, 27' formed through the valve plates 19, 19' at locations corresponding to the respective cylinder bores, as well as via suction valves 22, 22'; 23, 23'; 24, 24' formed of reed valves for closing and opening the respective suction ports 25–27' and formed integrally with valve sheets 52 and 52' interposed between the valve plates 19, 19' and the opposite ends of the cylinder block 1. The rear cylinder head 2' is formed with a suction port 28 opening in the rear suction chamber 20' and adapted for connection with an external circuit, not shown, such as a refrigerating circuit if the compressor is applied to an air conditioning system.

The front and rear cylinder heads 2, 2' are formed therein with annular front and rear discharge chambers 29 and 29' located outwardly of the respective front and rear suction chambers 20, 20' and disposed in concentricity therewith, with annular ribs 30 and 30' separating the chambers 29, 29' from the chambers 20, 20'. The front and rear discharge chambers 29, 29' communicate with the cylinder bores 9–11' via outlet openings 34, 34'; 35, 35'; and 36, 36' formed through the valve plates 19, 19 at locations corresponding to the cylinder bores, as well as via discharge valves 31, 31'; 32, 32'; and 33, 33' mounted on the valve plates 19, 19' on the side surfaces facing the discharge chambers 29, 29' for closing and opening the above outlet openings. Further, the front and rear discharge chambers 29, 29' communicate with the discharge passageway 17 via front and rear discharge through holes 19*c* and 19'*c* formed through the valve plates 19, 19'. The rear cylinder head 2' is formed therein with a discharge port 38 opening in the rear discharge chamber 29' and adapted for connection with the external circuit.

With the above arrangement of the double acting type compressor, as the swash plate 6 swingingly rotates in unison with rotation of the drive shaft 5, the pistons 12, 13, 14 engaging with the swash plate 6 reciprocatingly move within the respective cylinders bores 9, 9'; 10, 10'; 11, 11'. During the suction stroke of each piston, compression medium is drawn through the suction port 28 into the rear suction chamber 20', part of which is guided through the inlet opening 19'*a* of the rear valve plate 19', the suction passageway 15 and the suction through holes 19*a* of the front valve plate 19, into the front suction chamber 20. On this occasion, the suction spaces 16, 16' communicating with the suction chambers 20, 20' via the through holes 19*b*, 19'*b* substantially increase the internal volumes of the respective suction chambers 20, 20' so as to reduce the flow resistance which the suction compression medium undergoes as it is sucked into the suction chambers, thereby ensuring smooth suction of the compression medium into the compressor.

As the pistons 12–14 successively execute their respective suction strokes within the pump working chambers on the rear side, suction compression medium in the rear suction chamber 20' is successively drawn into the rear cylinder bores 9', 10', 11' or pump working chambers through the inlet openings 25–27 and the respective suction valves 22', 23', 24' which are successively opened. On the other hand, also, as the pistons successively execute their respective suction strokes within the pump working chambers on the front side, suction compression medium in the front suction chamber 20 is succesively drawn into the front cylinder bores 9, 10, 11 or pump working chambers through the inlet openings 25, 26, 27 and the successively opened suction valves 22, 23, 24. The suction compression medium thus introduced into the front and rear cylinder bores is then alternately compressed during the immediately following compression strokes of the pistons within the respective cylinder bores. The compression medium in the rear cylinder bores 9', 10', 11' forcingly opens the discharge valves 31', 32', 33' and is discharged through the outlet openings 34', 35', 36' into the rear discharge chamber 29'. On the other hand, compression medium in the front cylinder bores 9, 10, 11 forcingly opens the discharge valves 31, 32, 33 and is discharged through the outlet openings 34, 35, 36 into the front discharge chamber 29, and then travels through the discharge through hole 19*c* of the front valve plate 19, the discharge passageway 17, and the discharge through hole 19'*c* of the rear valve plate 19', into the rear discharge chamber 29', where it joins with the discharge compression medium from the rear cylinder bores 9', 10', 11', to be discharged through the discharge port 38 into the external circuit.

During the above operation of the conventional double acting type compressor, the compression medium from the front discharge chamber 29 is guided through the discharge passageway 17 which has rather a large cross-sectional area, while on the other hand, the compression medium from the rear discharge chamber 29' is discharged directly into the external circuit through the discharge port 38. That is, there is no action for throttling the flow of the discharge compression medium in either of the front and rear travelling paths for the discharge compression medium. As a consequence, the discharge compression medium, which contains pulsations due to discontinuous successive compression strokes caused by reciprocating motions of the pistons 12, 13, 14, is discharged into the external circuit without having its pulsations substantially attenuated. As a result, such compressor, if used as a refrigerant compressor in an air conditioning system for vehicles, will provide noise in the compartment of the vehicle.

Figure 3:
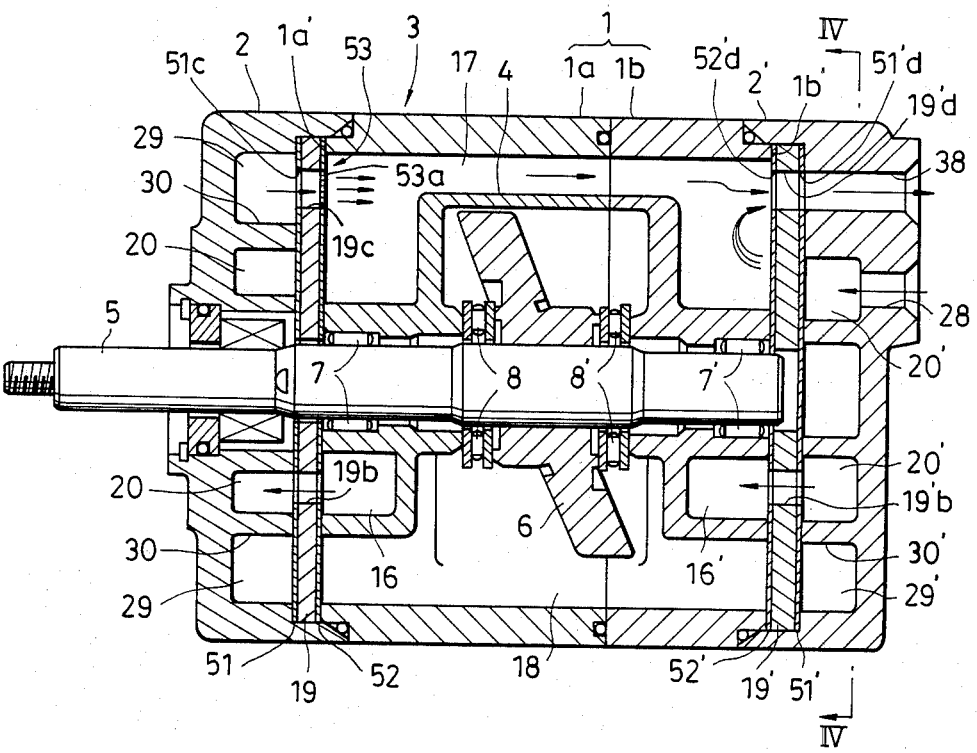
FIG. 3 is a longitudinal sectional view illustrating a swash-plate type compressor of the double acting type according to one embodiment of the present invention.
Figure 4:
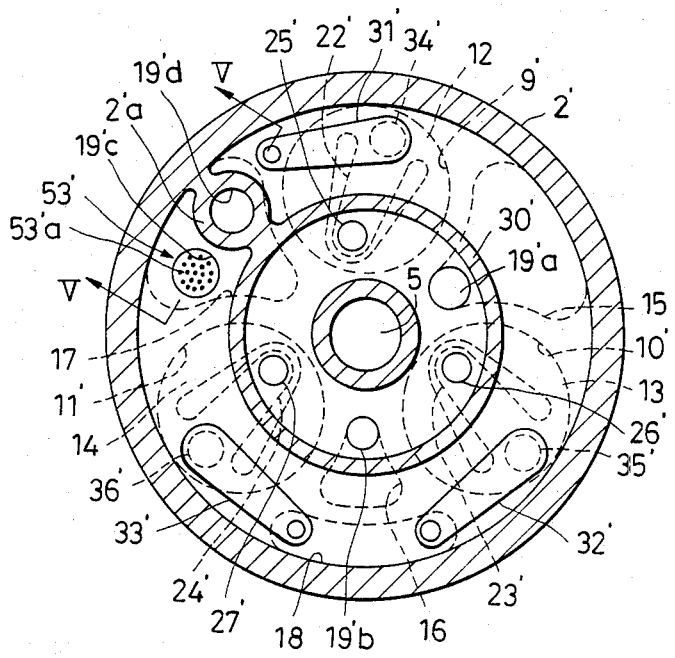
FIG. 4 is a cross-sectional view taken along line IV—IV in FIG. 3.
Figure 5:
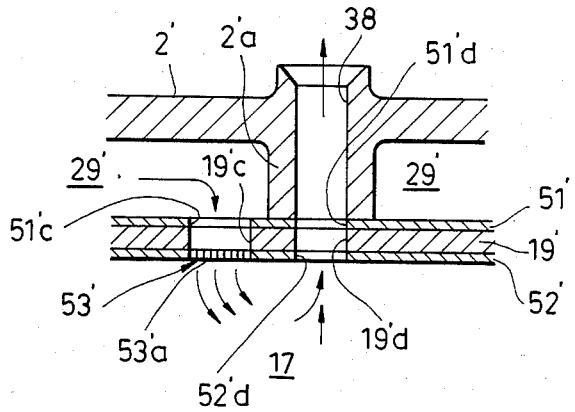
FIG. 5 is a fragmentary sectional view taken along line V—V in FIG. 4.

The present invention will now be described with reference to FIGS. 3 through 5 illustrating an embodiment thereof. In these figures, elements and parts corresponding to those in FIGS. 1 and 2 are designated by identical reference numerals.

According to the invention, a pulsation attenuation means is provided between each of the front and rear discharge chambers and the discharge passageway. The valve sheet 52 interposed between the front valve plate 19 and the cylindrical member 1*a* of the cylinder 1 has a porous portion 53 formed with a multiplicity of small through holes 53*a* facing the discharge through hole 19*c* in the valve plate 19 and forming the above pulsation attenuating means. These small through holes 53*a* communicate the discharge through hole 19*c* with the discharge passageway 17 so that the front discharge chamber 29 communicates with the discharge passageway 17 via a through hole 51*c* formed in the gasket 51, the discharge through hole 19*c* in the valve plate 19 and the small through holes 53*a*. Also at the rear side of the compressor, in the same manner as above, the valve sheet 52' interposed between the cylindrical member 1*b* and the rear valve plate 19' has a porous portion 53' formed with a multiplicity of small through holes 53'*a* facing the discharge through hole 19'*c* in the valve plate 19' and forming the pulsation attenuating means. Thus, the rear discharge chamber 29' communicates with the discharge passageway 17 via a through hole 51'*c* formed in the gasket 51', the discharge through hole 19'*c* and the small through holes 53'*a*. As the discharge compression medium passes the porous portions 53, 53', it has its pulsations attenuated or snubbed by the small through holes 53*a*, 53'*a* due to throttling of the flow of the discharge compression medium passing the through holes 53*a*, 53'*a*, as hereinafter described. The diameter and number of the small through holes 53*a*, 53'*a* are set at suitable values in relation to the cross-sectional area of the discharge passageway 17 such that the small through holes 53*a*, 53'*a* impart suitable flow resistance to the discharge compression medium as it passes the through holes 53*a*, 53'*a* so as to have its pulsations effectively attenuated but not to reduce the discharge capacity below a required value. That is, the total cross-sectional area of the small through holes 53*a*, 53'*a* of each valve sheet 52, 52' is set at a value substantially reduced relative to the cross-sectional area of a corresponding one of the discharge chambers 29, 29' but the cross-sectional area of the discharge passageway 17 is far larger than the total cross-sectional area of the through holes 53*a*, 53'*a* of each valve sheet 52, 52'. Thus, the compression medium has its flow velocity suddenly dropped in the discharge passageway 17 immediately after having its flow restricted by the small through holes 53*a*, 53'*a* which each act as an orifice, thereby having its pulsations effectively attenuated.

The rear cylinder head 2' is integrally formed therein with a substantially cylindrical solid portion 2'*a* axially extending in the discharge chamber 29' defined within the same cylinder head 2'. The solid portion 2'*a* is formed therein with the discharge port 38 axially extending therethrough and adapted for connection with the external circuit. On the other hand, the gasket 51', the rear valve plate 19' and the valve sheet 52' are formed with respective through holes 52'*d*, 19'*d* and 51'*d* in alignment with the discharge port 38 and communicating the latter with the discharge passageway 17. In this manner, the two front and rear discharge chambers 29, 29' are communicated with the discharge port 38 by means of the discharge pasageway 17 and the above through holes.

The parts and elements of the compressor according to the invention which are other than those described above are constructed and arranged in a substantially identical manner with the conventional compressor in FIGS. 1 and 2 previously described, description of which is therefore omitted.

The medium compressing operation of the swash-plate type compressor of the double acting type according to the invention constructed as above is substantially the same as the aforedescribed conventional compressor in that reciprocating motions of the pistons 12, 13, 14 cause suction of compression medium into the cylinder bores 9, 9'; 10, 10'; 11, 11' through the suction port 28, the rear suction chamber 20' and the front suction chamber 20 as the pistons in the cylinder bores execute their respective suction strokes, and compression of the thus sucked compression medium and discharge of same into the front and rear discharge chambers 29, 29' as the pistons subsequently execute their respective compression strokes. According to the compressor of the invention, the compression medium discharged into the front discharge chamber 29 is forced to pass the porous portion 53 of the valve sheet 52 interposed between the discharge through hole 19*c* of the valve plate 19 where it undergoes increased flow resistance to have its flow restricted, and then flows into the discharge passageway 17 which has a cross-sectional area much larger than the total cross-sectional area of the porous portion 53. On the other hand, likewise the compression medium discharged into the rear discharge chamber 29' has its flow restricted due to increased flow resistance as it passes the porous portion 53' of the valve sheet 52' and then flows into the large-volume discharge passageway 17 where it joins with the compression medium from the front discharge chamber 29, and the cojoined compression medium is supplied into the external circuit through the discharge port 38. As noted above, during the travel along this course, the compression medium delivered into the front and rear discharge chambers 29, 29' undergoes increased flow resistance and accordingly has its flow restricted as it passes the porous portions 53, 53' acting as orifices, and immediately thereafter it is delivered into the discharge passageway 17 with a large volume where it is considerably reduced in flow velocity and accordingly expanded in volume. This pulsation attenuating action is similar to the smoothing action of an electrical smoothing circuit. In addition to this, two groups of compression medium gas in the front and rear discharge chambers 29, 29' are delivered into the same discharge passageway 17 at different times from each other due to the difference in phase of the compression strokes on the front side and on the rear side which are alternately carried out, and are joined and mixed together. These two manners of travelling of the discharge compression medium cooperate to effectively damp or reduce the pulsations of the discharge compression medium flow which are caused by discontinuity between the compression stroke on the front side and the compression stroke on the rear side of each piston 12, 13, 14.

Although the above described embodiment is applied to a swash-plate type compressor of the double acting type which is generally used in an air conditioning system for vehicles to compress the refrigerant circulating therein, the invention is not limited to such type compressor, but it may be applied to other type double acting compressors in general, such as a wobble plate type compressor having variable displacement and a compressor having a crankshaft for causing reciprocating motions of the pistons.

What is claimed is

1. A double acting type compressor comprising:

a main body including a cylinder block having at least one cylinder bore axially extending therethrough and a pair of cylinder heads secured to opposite ends of said cylinder block;

at least one double headed piston received within said at least one cylinder bore for reciprocating motion therein;

a pair of suction chambers formed in said main body at opposite ends thereof, at least one of said suction chambers being disposed to be supplied with compression medium from outside;

a suction passageway formed in said main body and communicating said suction chambers with each other;

a pair of discharge chambers formed in said main body at said opposite ends thereof;

a discharge passageway formed in said main body and communicating said discharge chambers with each other;

a discharge port formed in said main body for allowing said compression medium to be discharged to the outside therethrough, said discharge port extending through one of said discharge chambers;

communication means communicating said discharge port substantially directly with said discharge passageway;

a pair of pulsation attenuating means interposed between said discharge chambers and said discharge passageway, each of said pulsation attenuating means having a multiplicity of small through holes formed therein, said small through holes communicating a corresponding one of said discharge chambers with said discharge passageway, said small through holes of each of said pulsation attenuating means having a substantially reduced total cross-sectional area relative to the cross-sectional area of said corresponding one of said discharge chambers so as to impart increased flow resistance to said compression medium passing said small through holes;

said discharge passageway having a substantially large cross-sectional area relative to the total cross-sectional area of said small through holes of each of said pulsation attenuating means;

said discharge port communicating with each of said discharge chambers solely through said communication means, said discharge passageway and a corresponding one of said pulsation attenuating means;

a pair of valve plates interposed between said cylinder heads and said cylinder block, each of said valve plates having a discharge through hole formed therein, said discharge through hole of each of said valve plates communicating a corresponding one of said discharge chambers formed within said cylinder heads with said discharge passageway axially extending through said cylinder block;

a pair of valve sheets interposed between said cylinder block and said valve plates, said small through holes of said pulsation attenuating means being formed in each of said valve sheets at a location facing said discharge through hole formed in a corresponding one of said valve plates;

said communication means comprising a first through hole formed through one of said valve plates corresponding to said one of said discharge chambers and a second through hole formed through one of said valve sheets corresponding to said one of said discharge chambers, said first and second through holes being aligned with said discharge port; and a gasket interposed between one of said cylinder heads within which said one of said discharge chambers is formed and said corresponding one of said valve plates;

said communication means further including a third through hole formed through said gasket and aligned with said discharge port;

whereby the total quantity of said compression medium discharged into said discharge chambers is caused to flow through said small through holes of said pulsation attenuating means into said discharge passageway, to thereby substantially attenuate pulsations of said compression medium and to reduce noise 2. A double acting type compressor as claimed in claim 1, including a drive shaft axially extending in said main body, and a swash plate rigidly fitted on said drive shaft for rotation in unison with said drive shaft, said swash plate engaging said double headed pistons for causing reciprocating motions of the latter within respective ones of said cylinder bores, as said swash plate rotates.

3. A double acting type compressor as claimed in claim 1, including a suction port formed in one of said cylinder heads and opening in a corresponding one of said suction chambers formed within said cylinder heads for allowing compression medium to be introduced from outside into said corresponding one of said suction chambers therethrough.

4. A double acting type compressor as claimed in claim 1, wherein said suction chambers are formed within said cylinder heads, each of said discharge chambers having an annular configuration and located radially outwardly of a corresponding one of said suction chambers, each of said discharge chambers and a corresponding one of said suction chambers being disposed concentrically of each other.

5. A double acting type compressor as claimed in claim 4, wherein said cylinder block has opposite ends thereof formed with a pair of suction spaces, each of said valve plates having a through hole formed therein and communicating a corresponding one of said suction chambers with a corresponding one of said suction spaces, whereby each of said suction chambers has a substantially increased internal volume.

* * * * *